United States Patent [19]

Iwamoto

[11] 4,442,982

[45] Apr. 17, 1984

[54] VENEER REELING UNIT

[75] Inventor: Yasuhiko Iwamoto, Ohbu, Japan

[73] Assignee: Meinan Machinery Works, Inc., Japan

[21] Appl. No.: 327,488

[22] Filed: Dec. 4, 1981

[30] Foreign Application Priority Data

Dec. 9, 1980 [JP] Japan ..... 55-174117

[51] Int. Cl.[3] ..... B65H 17/08; B65H 75/02

[52] U.S. Cl. ..... 242/55; 242/65; 242/67.2

[58] Field of Search ..... 242/55, 54 R, 67.1 R, 242/67.2, 65, 66, 62, 77.1, 1, 59; 53/118, 119

[56] References Cited

U.S. PATENT DOCUMENTS

| | | | |
|---|---|---|---|
| 1,825,782 | 10/1931 | Duff | 242/59 |
| 3,247,956 | 4/1966 | Rosen | 242/1 |
| 3,677,484 | 7/1972 | Yazawa et al. | 242/54 R |
| 4,181,269 | 1/1980 | Ketteler et al. | 242/65 |

FOREIGN PATENT DOCUMENTS

| | | | |
|---|---|---|---|
| 2258095 | 6/1974 | Fed. Rep. of Germany | 242/67.2 |
| 57-70602 | 1/1982 | Japan . | |
| 57-57378 | 4/1982 | Japan . | |

*Primary Examiner*—John M. Jillions

[57] ABSTRACT

A veneer reeling unit in a device for reeling veneer is provided. The unit comprises a rotatable reeling roll disposed in parallel to the grain of veneer sheet to be wound thereon, thread storage member which contains a winding of thread of a required length for supplying said thread during reeling operation and re-collecting said thread after said operation, and thread guiding member which is adapted to guide said thread supplied from the said storage member so that the thread may be wound together with the veneer round the periphery of said reeling roll in such a way that the former may guide and support the latter. The use of this unit in reeling device can make possible smooth reeling of veneer sheets of various shapes and widths.

4 Claims, 15 Drawing Figures

VENEER REELING UNIT

BACKGROUND OF THE INVENTION

The present invention relates to a veneer reeling unit for winding veneer sheets of various shapes and widths round the periphery of a rotated reeling roll by the aid of at least a strand of thread which is wound with the veneer sheets around the veneer sheets and wound therewith round said periphery of the rotated reeling roll to support and guide the veneer sheets.

In a veneer handling process of winding veneer sheets which are conveyed from a veneer lathe or clipper round the reeling roll in a conventional veneer reeling device, it has been a customary practice to wind initially by hand the leading end of an incoming veneer sheet onto the veneer reeling roll at the beginning of each reeling operation. With such prior art reeling device, the trailing end of a full veneer winding, or a winding of venner sheets which is formed when the reeling opertion has been completed, should be also secured to the veneer winding by use of any suitable means for preventing the outer free end of the winding from drooping by its own weight during transferring said winding to the subsequent unreeling station where the wound veneer is to be unreeled. However, this manner of reeling the veneer sheets, in particular those sheets which have a number of defects therein such as cracks, splits, decayed spots, etc. or those sheets which are of incontinuous form having irregular shapes and widths, calls for a number of workmen and large working area and space necessary for the abovesaid work steps. In addition, handling of veneer sheets by hand inevitably causes damages thereto, thereby inviting a decrease in veneer recovery, as well as in production efficiency.

As disclosed in the Japanese Patent Provisional Publication No. 52(1977)-10410 which is designed to improve the veneer winding process, it is known to use at least a strand of thread which is paid out from a spool as a means for guiding and supporting the veneer sheets around the periphery of a rotated reeling roll by being wound together with the veneer sheets. This arrangement has eliminated the fear of damages to the veneer sheets due to the centrifugal force created during the reeling operation and made it possible to reel the veneer sheets successfully into a neat winding, thus offering an advantage in that an incontinuous flow of veneer sheets having varying widths may be handled successfully. However, the problem associated with manually winding the leading ends of both the thread and veneer around the reeling roll and previously tying the thread's leading end to the reeling roll has remained unsolved. Moreover, the thread supplied from its spool should be cut off at a convenient position by any appropriate cutting means after the veneer winding of any desired storage has been formed, and thereafter the cut free end of the thread should be secured to the veneer winding so that the free end of the last veneer sheet in the winding may not droop by its own weight from the winding on the reeling roll. In the subsequent process of unwinding or unreeling of the veneer, therefore, the trailing ends of the thread and veneer must be located and then released from the winding. Furthermore, in order to permit the reuse of the thread re-collected after each unreeling operation, the cut end of the thread may have to be tied with an end of another thread to make a new strand of thread. However, repetition of such cutting and tying will make many knots in the thread, thereby affecting the smoothness in the reeling and unreeling operation, as well as deteriorating the thread quality. In this way, although the prior art according to the abovesaid Japanese Patent Provisional Publication which features the use of a reeling thread has contributed remarkably to the improvement of the veneer winding process, the problem associated with the thread handling is yet to be solved.

SUMMARY OF THE INVENTION

Therefore, an object of the present invention is to eliminate the afore-mentioned disadvantages and drawbacks by providing a veneer reeling unit which is capable of handling veneer sheets of various shapes and widths with a higher degree of operating efficiency but reliability, and with less input of labor.

Another object of the invention is to provide a veneer reeling unit which realizes improvement in stability and ease of the subsequent veneer unreeling operation.

In order to fulfill the above objects, there is provided a veneer reeling unit comprising a rotated reeling roll which is disposed in parallel to the grain of incoming veneer sheets, a rotatable thread storage member which contains therein a winding of thread, and a thread guiding member which is disposed to guide said thread paid out from said storage member so that the thread may be wound together with the veneer sheets around said roll, said thread storage member and thread guiding member being arranged in such a way that they are integrally moveable together with said reeling roll.

Other objects and features of this invention will become apparent from the following description of embodiments of the veneer reeling unit according to the invention, which description is made with reference to the accompanying drawings in which:

DETAILED DESCRIPTION OF THE PREFERRED EMBODIMENTS

Figure 1:
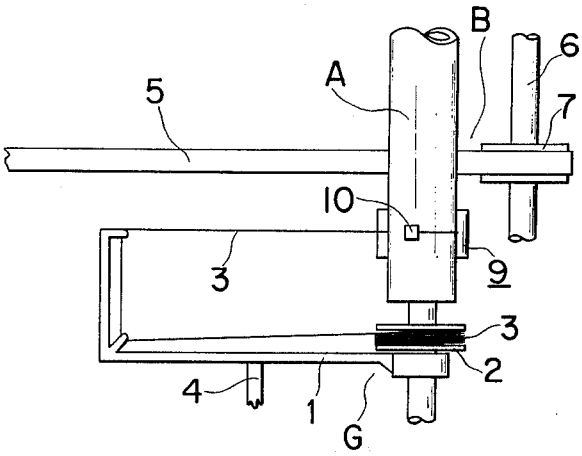
FIG. 1 is a fragmentary plan view showing an embodiment of the veneer reeling unit according to the present invention
Figure 2:
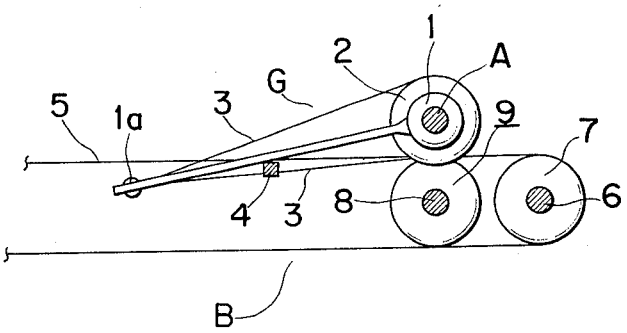
FIG. 2 is a side view of the unit of FIG. 1.
Figure 3:
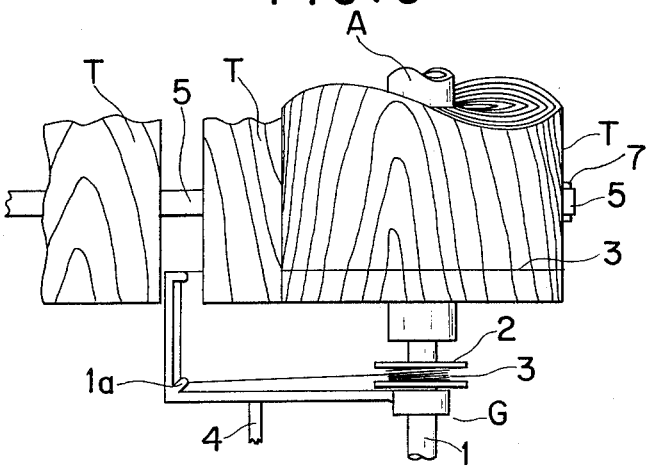
FIG. 3 is a fragmentary plan view of the veneer reeling unit of FIG. 1, showing how veneer sheets are being wound or reeled around the reeling roll.

The following will provide the description of various preferred embodiments of the veneer reeling unit according to the present invention:

Referring to FIGS. 1 and 2 a rotated reeling roll A for winding veneer sheets therearound is disposed with its axis placed in perpendicular relation to the direction in which the veneer sheets are conveyed on a conveyor belt 5 which is driven by a pulley 7 mounted on a shaft 6. The reeling roll A is driven by a roller 9 which is mounted on a drive shaft 8 and kept in contact with the periphery of a veneer winding being formed on the roll A. A thread storage member in the form of a spool 2 for accommodating therein a winding of thread 3 is installed rotatably on the reeling roll A at a position thereof where the veneer sheets are not to be wound, e.g. at a small-diameter end portion of the roll A as shown in FIG. 1. A thread guiding member in the form of an arm 1 is mounted pivotably on said reeling roll A adjacently to the spool 2, and configured to include a first portion extending from said end portion in perpendicular relation to the axis of said reeling roll and a second portion extending then in parallel thereto so as to lead the thread 3 paid out from the spool 2 and guide it to any desired position adjacent to the reeling roll A so that the thread 3 thus supplied may be wound with the veneer sheets, as best shown in FIG. 3. It should be noted here that the thread spool 2 and the thread guiding arm 1 are mounted freely on said end portion of the reeling roll A, i.e. in such a way that their rotation and pivoting may not be influenced in any way by the rotating motion of the reeling roll A. The arm 1 is provided with any convenient number of eyelets 1*a* for leading the thread 3 paid out from the spool 2 along any desired passage of the thread. A stationary stop member 4 is provided fixedly, e.g. to the frame of a veneer conveyor, for limiting downward movement by gravity of said thread guiding arm 1, thus determining its lowermost position. The reference numeral 10 designates an adhesive tape as a means for fixing the leading end of the thread 3 permanently on the surface of the reeling roll A. As the fixing means, any adhesive tape may be used provided that it can serve the above purpose of the fixing means.

As illustrated in the above, this embodiment of the veneer reeling unit, which is designated generally by the reference letter G, of the invention comprises a rotatable reeling roll A around which the veneer sheets are wound or reeled, a thread storage member 2 containing a winding of thread 3 therein and allowing said thread 3 to be unwound therefrom, and a thread guiding member 1 for guiding the thread thus unwound from the storage member 2 to any desired position so that the thread 3 thus supplied may be wound with veneer sheets around said reeling roll A, said thread storage member 2 and thread guiding member 1 being arranged on one end of said reeling roll A at a position which is clear of the veneer sheets reeled round the roll so that the reeling roll, thread storage member and thread guiding member are arranged substantially in an integrally assembled structure which may be moved or transferred, when required, as a unit.

Figure 4:
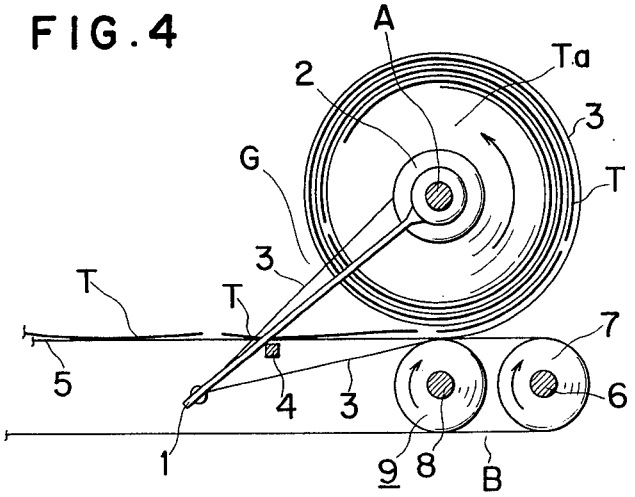
FIG. 4 is a side view of FIG. 3.

In operation, as shown clearly in FIGS. 3 and 4, a veneer sheet T is fed toward the reeling Roll A by a feed conveyor B and reaches just beneath the rotating reeling roll A; it is wound round the reeling roll together with the thread 3 which guides and presses the same in the reeling operation. Such reeling operation is continued until any veneer winding Ta of a desired storage size or diameter is formed. It is thus apparent that the veneer reeling operation on the above reeling device can be performed with an extreme efficiency and smoothness by the aid of the veneer guiding and supporting thread 3, with the result that possible damages to the veneer sheets T may be prevented successfully. Furthermore, since the thread spool 2 and guiding arm 1 are constructed, as stated earlier substantially integrally with the reeling roll A and therefore moveable therewith in transferring the veneer winding Ta from its reeling to the unreeling station, it is made possible to secure in advance the leading end of the thread 3 permanently to the reeling roll A, thereby eliminating the problem associated with fixing such leading end of the thread to the reeling roll A prior to starting of each veneer reeling operation. Cutting off the thread after the veneer winding Ta of any desired storage size is obtained can be dispensed with as a matter of course. With the veneer reeling unit G thus constructed, merely winding the thread 3 by a couple of extra turns about the veneer winding Ta can help prevent unexpected unreeling of the winding Ta. As a further advantage in the unreeling operation, the trailing end of the thread 3 does not have to be located, but the spool 2 only has to be rotated in its winding direction for re-collecting the thread back into the spool. Besides, since no tying knots will be formed in the thread 3, the reeling and unreeling operations can be performed repeatedly with the use of the same thread.

Figure 5:
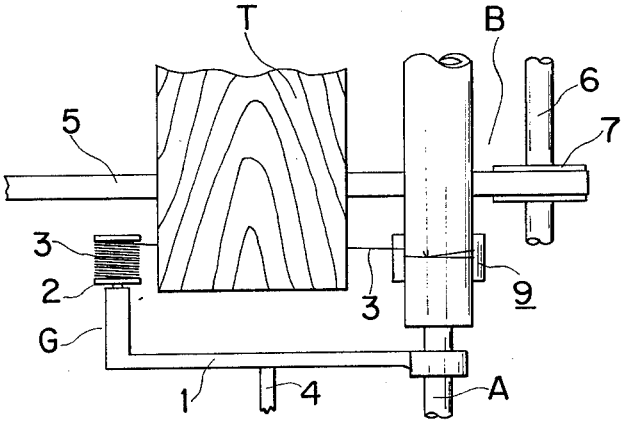
FIGS. 5, 7 and 9 are fragmentary plan views showing other embodiments of the veneer reeling unit according to the present invention, respectively.
Figure 6:
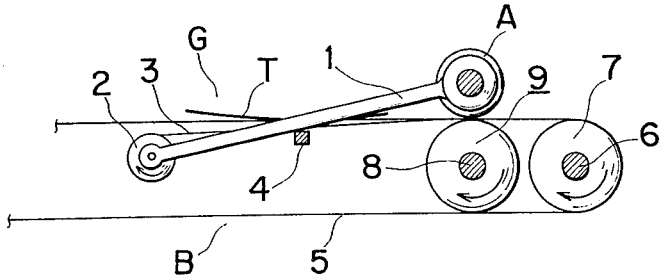
FIGS. 6, 8 and 10 are side views of FIGS. 5, 7 and 9, respectively.

Referring to FIGS. 5 and 6 showing a second embodiment of the veneer reeling unit of the invention, the thread guiding member also in the form of an arm 1 is provided such that one end thereof is pivotably installed on the reeling roll A substantially in the same manner as in the previous first embodiment hereof and the other end thereof carries the thread storage member or a rotatable thread spool 2 in which a winding of the thread 3 is stored. As it is shown clearly from FIG. 5, the arm 1 has no thread leading means such as the eyelets 1*a* shown in FIG. 3 because the thread spool 2 itself is disposed on the arm at a position where the thread 3 paid out therefrom directly may be wound up with the veneer sheets T around the reeling roll A. To secure the leading end of the thread 3 to the reeling roll A, it may be held permanently to the roll A by means of adhesive, fasteners such as a rivet or the like, as well as adhesive tape 10 mentioned in reference to the first embodiment hereof. Merely winding the thread end a number of turns round the reeling roll A can meet the requirement of holding the thread end. In short, provided that the thread leading end is securely held to the reeling roll, manually reeling the leading end of the thread with the first-coming veneer sheet T around the reeling roll can be advantageously omitted, thus the veneer reeling operation can be made much easier than heretofore.

Figure 7:
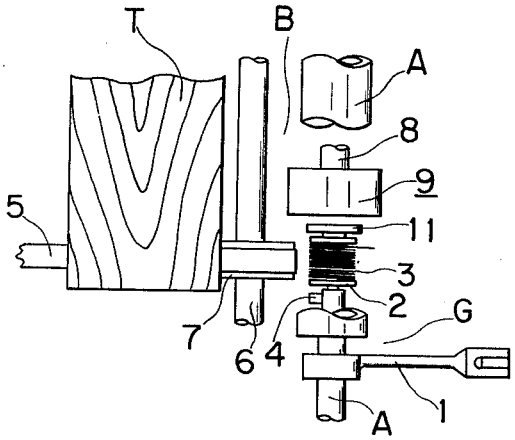
Figure 8:
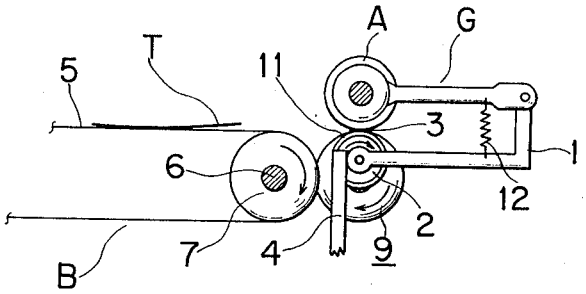

Reference is now made to FIGS. 7 and 8 illustrating a third embodiment of the veneer reeling unit of the present invention, wherein the arm 1 is configured into a two-part foldable arrangement, as best seen in FIG. 8, and spring 12 is provided which is adapted to act in such a direction as to fold the arm's two components toward each other. By so arranging the arm 1, the veneer reeling unit G, regardless of whether or not it carries the thread winding Ta, requires less space for the transferring of the unit. In addition, the divided arrangement of arm 1 can make possible changing of the thread guiding position in relation to the veneer sheets T to be reeled merely by replacing either of the arm components with a different one. In the embodiment of FIGS. 7 and 8, the reference numeral 11 indicates an idle roller installed rotatably on the free end of the arm 1 adjacently to the thread spool 2 and having a diameter greater than that of the spool 2, for preventing the spool 2 from being brought into contact with either of the reeling roll A or thread winding Ta.

Figure 9:
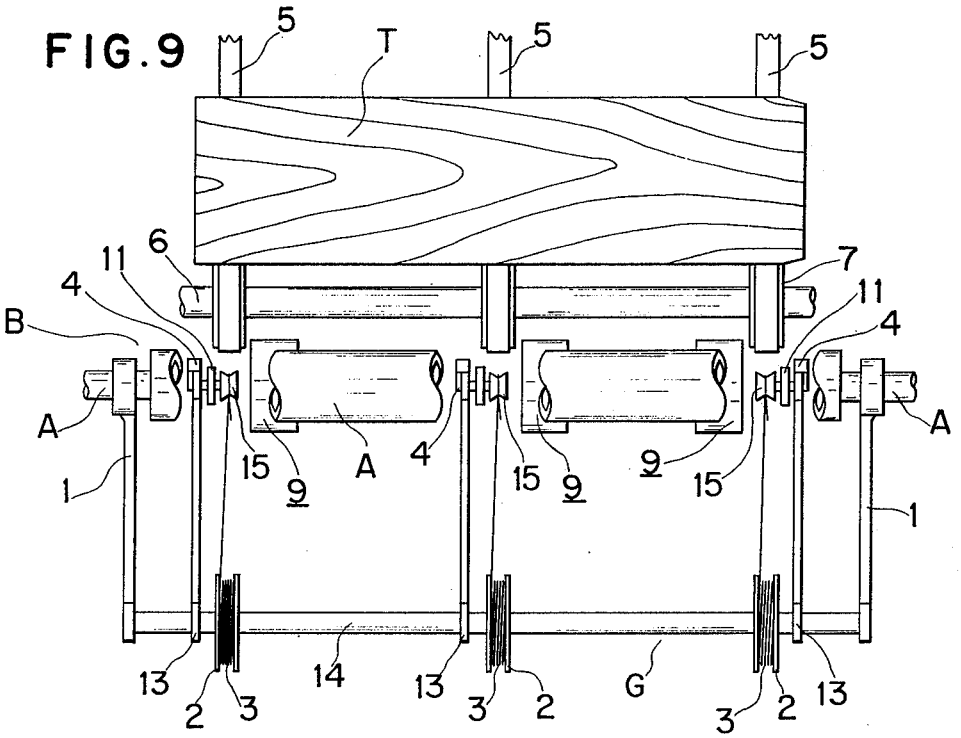
Figure 10:
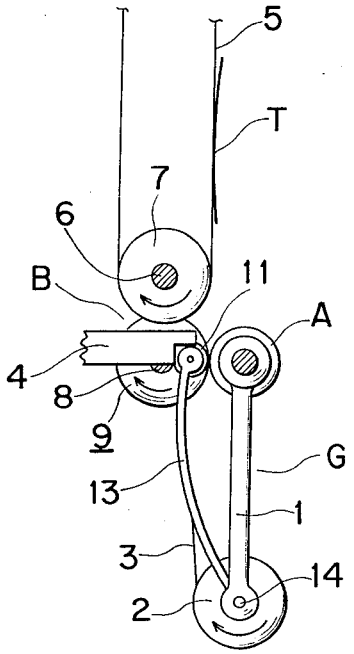

Referring to FIGS. 9 and 10, a fourth embodiment of veneer reeling unit of the invention is illustrated, wherein the unit G includes the thread guiding member which comprises a pair of main arms 1 whose ends on one side are rotatably mounted on the opposite ends of the reeling roll A, a supporting shaft 14 which rotatably supports the other ends of said pair of arms 1, and a plurality of auxiliary arms 13 each carrying rotatable idle roller 11 and a thread guiding roller 15 at one end thereof and supported at the other opposite end thereof by said supporting shaft 14, said auxiliary arms 13 being disposed in spaced relation to each other along the supporting shaft 14. The same number of the thread storage members or spools 2 as the auxiliary arms 13 are rotatably installed on said supporting shaft 14 adjacently to each of said other opposite ends of the auxiliary arms 13, as shown in FIG. 9. As it is now apparent from the foregoing, with this veneer reeling unit the thread guiding positions along the axial direction of reeling roll A can be changed as required by sliding the auxiliary arms 13 along the supporting shaft 14. In this embodiment, it is also possible to increase the number of strands of thread 3 by adding or removing the auxiliary arms 13 with the corresponding number of the thread spools 2.

As it is now understood from the foregoing description of the various embodiments of the veneer reeling unit of the present invention, the thread guiding member is not limited to any specific arrangements or forms but, various modifications thereof may be contemplated, e.g. a foldable-type arm equipped with a thread guiding eyelet or roller, an arm which is attached to the thread storage member installed on the reeling roll, and so forth. In short, the thread guiding member of any configuration can serve its intended purpose, provided that it is capable of guiding the thread paid out from the thread storage member toward any desired position adjacent the reeling roll and also that it is constructed substantially in an integrally assembled form with the reeling roll and the thread storage member.

As to the thread storage member as well, it should be understood that it may be embodied in other various forms than the spool in the foregoing description of the concrete embodiments. Since the thread storage member can accommodate a required length of the thread winding therein and allow it to be paid out therefrom properly and also it is is arranged substantially integrally with the reeling roll, it may be constructed in any modified form. In order to facilitate re-winding the thread during veneer unreeling operation, the thread storage member may be advantageously driven in a positive manner in a direction to wind up the thread for re-collecting the same thereinto.

As for the thread means for use in the invention, it includes a twisted staple yarn made of natural or synthetic textile fibers, any blend thereof, a yarn in the form of solid filament, and even a thread with belt-like section. Besides the thread of textile materials, various kinds of other materials may be employed as the thread means, including synthetic resins, metals, etc. In short, the thread means of any material and form is usable, as far as it is fine and strong enough for its application.

Though not shown in the attached drawings for the sake of clarity of illustration, a brake machanism may be advantageously provided at any convenient position in either thread storage member or the thread guiding member for preventing the thread from becoming slackened during the veneer reeling operation.

To ensure stability in the veneer reeling, it is preferable to provide at least two strands of thread. However, when handling exclusively the veneer sheet in the form of a continuous band having therein defects such as splits only on one side thereof, e.g. the veneer sheet which is obtained from peeling a log having splits on its one end only, the use of only one strand of thread would be adequate. If a number of strands of thread are arranged, a variety of veneer sizes can be handled by a single veneer reeling device.

Figure 11:
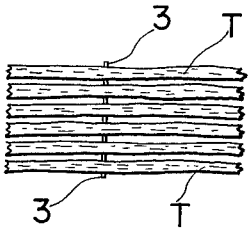
FIG. 11 is a fragmentary section of a veneer winding obtainable when the thread is guided at the same position.
Figure 12:
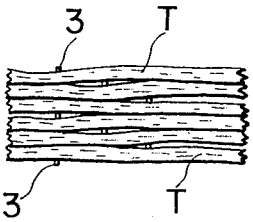
FIG. 12 is also a fragmentary section of another veneer winding obtainable when the thread is guided in a staggered manner.

If the veneer sheets T are reeled with the accompanying thread 3 guided always at a fixed position as shown in FIG. 11, the resulting veneer winding Ta tends to be formed larger in diameter for a given length of the veneer winding. Such a tendency can be prevented if the thread guiding position is changed periodically while the veneer sheets are being reeled so that the thread may be wound up in the veneer winding Ta in a staggered manner, as indicated in FIG. 12. Such insertion of the thread into the veneer winding Ta can be accomplished, e.g., by previously winding the thread on the spool into a traversed winding or by providing the thread guiding arm with a slight traversing motion along the axis of the reeling roll A during the veneer reeling operation.

To realize smooth unreeling of the veneer winding Ta, special care should be taken to protect the veneer sheets against damages and disorder. That is, should the unreeling be performed such that the thread 3 lies on the upper surfaces of the veneer sheets in their unreeled state, the latter will be released from engagement with the thread and winding Ta, thus being allowed to fall by its own weight or to be twisted in either direction with the result it may be damaged or disordered. Therefore, it is preferred that the veneer sheets T should be unreeled with the thread 3 positioned on the lower surfaces thereof, namely in the state where the former is supported by the latter.

Figure 13:
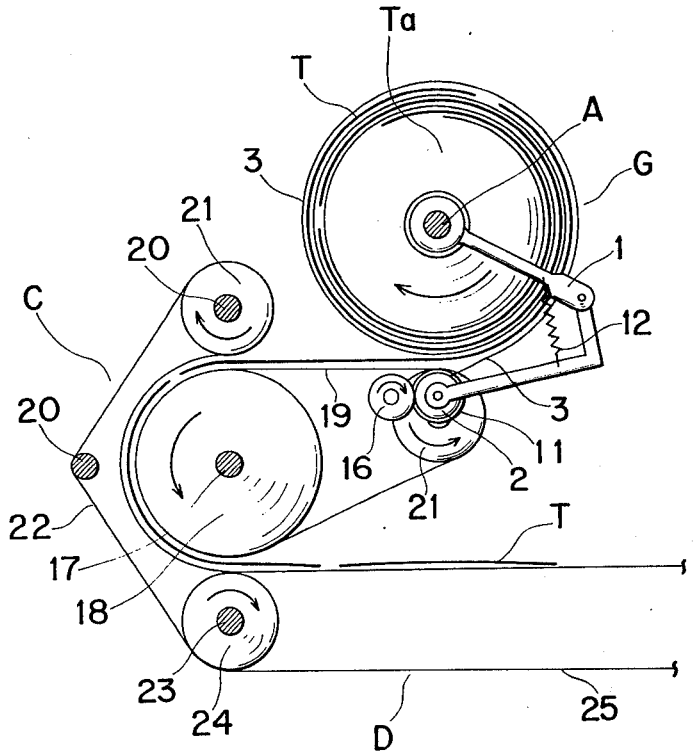
FIGS. 13 and 15 are side views, respectively. showing the manner in which the veneer sheets and thread are unwound or unreeled with the latter placed under and supporting the former at the point of unreeling.
Figure 14:
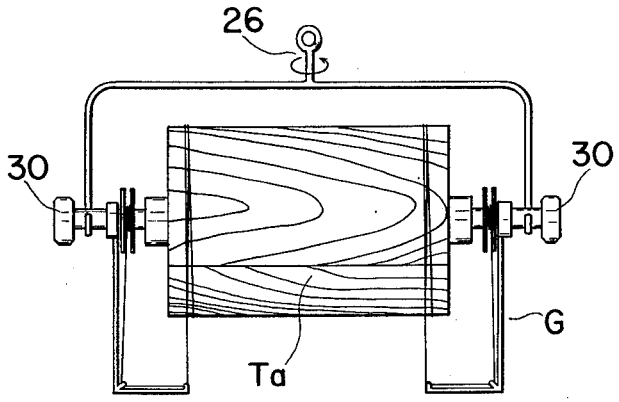
FIG. 14 is a front view showing the veneer reeling unit of the invention which carries a winding of veneer on the reeling roll thereof and is supported by a hook member for turning said winding by 180 degrees.
Figure 15:
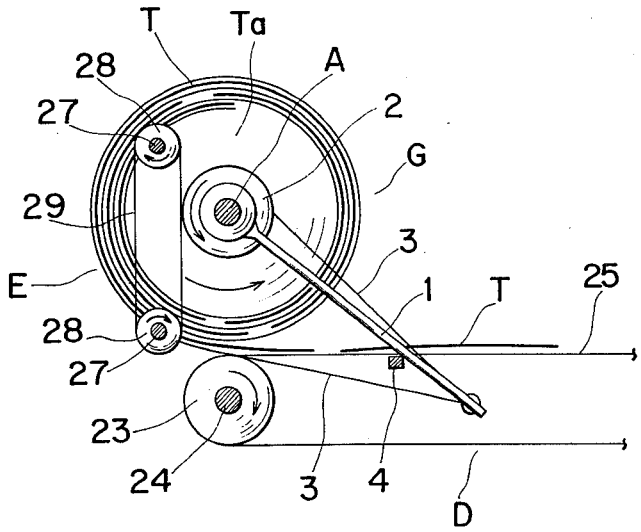

To ensure such smoothness and safety in unreeling the veneer winding Ta, the veneer sheets are drawn out from the winding Ta firstly in backward direction, then reversed the aid of by the aid of a reversing mechanism C comprising shafts 17, 20, pulleys 18, 21 and belts 19, 22, and thereafter conveyed in forward direction by a delivery conveyor D including a shaft 23, pulley 24 and a belt 25, as shown in FIG. 13. alternatively, the veneer winding Ta itself may be turned 180 degrees by using a hook means 26 shown in FIG. 14 on the way from its reeling station to the unreeling station, where it is unreeled onto the delivery conveyor D, as shown in FIG. 15. By so unreeling, the veneer sheets which have just been released from engagement with the thread 3 and the remaining veneer winding Ta can be prevented from falling down or being disordered and, therefore, the fear of damages and disturbances to the veneer sheets may be eliminated successfully. For reference, the numeral 16 in FIG. 13 designates a roller to drive the thread spool 2 in a direction for re-collecting the thread 3 back into said spool; the device which is designated by the reference letter E in FIG. 15 is a thread spool driving mechanism including a drive belt 29 and rollers 28 mounted on shafts 27 for re-collecting the thread 3; and the reference numeral 30 in FIG. 14 indicates rollers fitted on opposite ends of the veneer reeling roll A.

It should be mentioned here that the veneer reeling unit of the present invention can be used in combination with known veneer reeling apparatuses, or with the improved veneer reeling devices as disclosed by the Japanese Patent Application Nos. 55(1980)-80671 and 55(1980)-147965.

Furthermore, the veneer reeling unit of the invention may be applied for winding those veneer sheets which are reinforced by a string buried with adhesive in cuts formed in said veneer sheets across the grain thereof. In such an application, the use of the veneer reeling unit of the invention can contribute to keeping the veneer sheets thus reinforced from being disordered due to disengagement from the reinforcing string, until said adhesive gains a desired cured state.

Thus, the present invention contemplates to provide a veneer reeling unit which features a novel arrangement comprising a rotated reeling roll disposed with its axis in parallel to the grain of the veneer sheets being fed thereto and adapted to wind said veneer sheets therearound, a thread storage member adapted to accomodate therein a winding of thread and to supply the thread successively, and a thread guiding member adapted to guide the thread supplied from said storage member in such a way that said thread may guide and support the veneer sheets being reeled and eventually be wound up therewith around said reeling roll, said thread storage member and said thread guiding member being arranged substantially integrally with the reeling roll, whereby said members are movable integrally with the reeling roll. This veneer reeling unit may be installed at various stations between any two succesive processes in a veneer processing mill, e.g. between veneer lathe and clipper, veneer clipper and drier, veneer driver and composer, and so forth. In this way, the present invention is capable of contributing greatly to mechanizing the veneer handling at various phases in the production line in the veneer and plywood mills, thereby realizing improvement in labor saving in such mills.

What we claim is:

1. A veneer reeling unit for reeling veneer sheets successively together with at least one strand of thread for guiding and supporting said veneer sheets round a rotated reeling roll disposed with its axis extending substantially in parallel to the grain of said veneer sheets, comprising:

a thread storage member for containing therein said thread in the form of a winding and allowing said thread to be paid out therefrom, and a thread guiding member for guiding said thread in such a way that the thread may be wound up with said veneer sheets around said reeling roll, said thread storage member and thread guiding member being so arranged that they are moveable integrally with said reeling roll as a unit.

2. A veneer reeling unit according to claim 1, wherein said thread storage member is provided rotatably on said reeling roll at an end portion thereof where said veneer sheets are not to be reeled, and said thread guiding member is provided pivotably on said reeling roll adjacently to said thread storage member and has a configuration which includes a first portion extending from said end portion in perpendicular relation to the axis of said reeling roll and a second portion extending then in parallel thereto.

3. A veneer reeling unit according to claim 1, wherein said thread guiding member is provided pivotably on said reeling roll at an end portion thereof where said veneer sheets are not to be reeled and has a configuration which includes a first portion extending from said end portion in perpendicular relation to the axis of said reeling roll and a second portion extending then in parallel thereto, and said thread storage member is provided rotatably on said second portion of the thread guiding member.

4. A veneer reeling unit according to anyone of claims 1, 2, or 3, wherein said thread storage member includes a spool which is driven positively.

* * * * *